US008566085B2

(12) United States Patent
Miao et al.

(10) Patent No.: US 8,566,085 B2
(45) Date of Patent: Oct. 22, 2013

(54) PREPROCESSING METHOD, PREPROCESSING APPARATUS AND CODING DEVICE

(75) Inventors: Lei Miao, Shenzhen (CN); Fengyan Qi, Shenzhen (CN); Jianfeng Xu, Shenzhen (CN); Dejun Zhang, Shenzhen (CN); Qing Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 466 days.

(21) Appl. No.: 12/724,066

(22) Filed: Mar. 15, 2010

(65) Prior Publication Data

US 2010/0232540 A1 Sep. 16, 2010

(30) Foreign Application Priority Data

Mar. 13, 2009 (CN) ..... 2009 1 0117884
Jun. 25, 2009 (CN) ..... 2009 1 0149822

(51) Int. Cl.
*G10L 19/00* (2013.01)

(52) U.S. Cl.
USPC ..... 704/219; 704/216; 704/217; 704/218

(58) Field of Classification Search
None
See application file for complete search history.

(56) References Cited

U.S. PATENT DOCUMENTS 5,457,783 A 10/1995 Chhatwal
5,526,464 A 6/1996 Mermelstein
5,838,269 A * 11/1998 Xie ..... 341/139
6,141,639 A * 10/2000 Thyssen ..... 704/219
6,205,423 B1 * 3/2001 Su et al. ..... 704/233
6,397,178 B1 * 5/2002 Benyassine ..... 704/230
6,873,954 B1 * 3/2005 Sundqvist et al. ..... 704/262
7,792,670 B2 * 9/2010 Jasiuk et al. ..... 704/219
2003/0009325 A1 * 1/2003 Kirchherr et al. ..... 704/211
2004/0010407 A1 * 1/2004 Kovesi et al. ..... 704/219

FOREIGN PATENT DOCUMENTS

CN 1922659 A 2/2007
CN 101609677 B 1/2012
EP 0733257 A1 9/1996
JP 9-152897 A 6/1997
WO WO 95/06310 A1 3/1995

* cited by examiner

*Primary Examiner* — Leonard Saint Cyr
(74) *Attorney, Agent, or Firm* — Leydig, Voit & Mayer, Ltd.

(57) ABSTRACT

The present disclosure relates to coding and decoding technologies, and discloses a preprocessing method, a preprocessing apparatus, and a coding device. The preprocessing method includes: obtaining characteristic information of a current frame signal; identifying whether the current frame signal requires no coding operation of removing LTC according to the characteristic information of the current frame signal and preset information; and if identifying that the current frame signal requires no coding operation of removing LTC, performing the coding operation of removing STC for the current frame signal; and if identifying that the current frame signal requires the coding operation of removing LTC, performing the coding operations of removing both LTC and STC for the current frame signal. Through the technical solution provided herein, the coding operation of removing LTC is performed for only part of the input frame signals.

16 Claims, 7 Drawing Sheets

PREPROCESSING METHOD, PREPROCESSING APPARATUS AND CODING DEVICE

CROSS-REFERENCE TO RELATED APPLICATIONS

This application claims priority to Chinese Patent Application No. 200910117884.8, filed Mar. 13, 2009, and Chinese Patent Application No. 200910149822.5, filed Jun. 25, 2009, both of which are hereby incorporated by reference in their entireties.

FIELD OF THE DISCLOSURE

The present disclosure relates to coding and decoding technologies, and in particular, to a preprocessing method, a preprocessing apparatus, and a coding device.

BACKGROUND

In order to save the bandwidth required for speech and audio signal transmission and save the storage space required, the corresponding speech and audio coding technologies are applied widely. Currently, the speech and audio coding is categorized into lossy coding and lossless coding. The lossy coding and the lossless coding generally involve the Linear Prediction (LP) operation and the Long Term Prediction (LTP) operation. The LP operation is introduced to eliminate the short-term redundancy of the speech signals, and the LTP operation is introduced to further eliminate the long-term redundancy of the speech signals, and improve the compression efficiency. The LTP operation involves the operations such as pitch search, and is rather complicated.

A coding scheme that involves LP operation and LTP operation in the prior art is: performing LP operation and LTP operation for all input frame signals first; specifically, after completion of the LP operation, performing LTP operation for the LP residual signals to obtain the LTP prediction residual; after completion of the LTP operation, performing LTP decision according to the LP residual and the LTP prediction residual, setting the value of LTP flag (LTPFlag) according to the LTP decision result and output the value; if LTPFlag=1, performing the entropy coding on the LP residual signal and the LTP residual signal and outputting; if LTPFlag=0, performing the entropy coding on the LP residual signal and outputting.

The inventor of the present disclosure finds in the prior art that: The LTP operation is effectively primarily on the voiced signals. In a practical conversation, the silence and unvoiced signals account for 60% or more. Therefore, the coding based on the prior art performs the LTP operation for all input frame signals, which reduces the coding efficiency and increases the coding complexity.

SUMMARY

A preprocessing method provided in an embodiment of the present disclosure includes: (1) obtaining characteristic information of a current frame signal; identifying whether the current frame signal requires no coding operation of removing Long Term Correlation (LTC) according to the characteristic information of the current frame signal and preset information; and (3) if the current frame signal requires no coding operation of removing LTC, performing a coding operation of removing Short Term Correlation (STC) for the current frame signal; if the current frame signal requires the coding operation of removing LTC, performing coding operations of removing both LTC and STC for the current frame signal.

A preprocessing apparatus provided in an embodiment of the present disclosure includes: (1) an obtaining unit, configured to obtain characteristic information of a current frame signal; (2) an identifying unit, configured to identify whether the current frame signal requires no coding operation of removing LTC according to the characteristic information of the current frame signal obtained by the obtaining unit and preset information; and (3) an operating unit, configured to perform coding operations of removing both LTC and STC for the current frame signal if the identifying unit identifies that the current frame signal requires the coding operation of removing LTC; or perform the coding operation of removing STC for the current frame signal if the identifying unit identifies that the current frame signal requires no coding operation of removing LTC.

A coding device provided in an embodiment of the present disclosure includes: (1) a preprocessing apparatus, configured to obtain characteristic information of a current frame signal; identify whether the current frame signal requires no coding operation of removing LTC according to the characteristic information of the current frame signal and preset information; perform a coding operation of removing STC for the current frame signal if the current frame signal requires no coding operation of removing LTC, or perform coding operations of removing both LTC and STC for the current frame signal if the current frame signal requires the coding operation of removing LTC; and (2) entropy coding apparatus, configured to perform entropy coding for the current frame signal by using a result of the coding operation by the preprocessing apparatus.

According to the foregoing technical solution, the embodiments of the present disclosure identify whether the current frame signal requires a coding operation of removing LTC according to the characteristic information of the current frame signal, perform only the coding operation of removing STC for the current frame signal if identifying that the current frame signal requires no coding operation of removing LTC, and perform coding operations of removing both LTC and STC for the current frame signal as long as it is identified that the current frame signal requires the coding operation of removing LTC. Therefore, the coding operation of removing LTC is performed for only part of the input frame signals, the resource consumption caused by some coding operations for removing LTC is avoided, the coding complexity is reduced, and the coding efficiency is improved.

BRIEF DESCRIPTION OF THE DRAWINGS

In order to make the technical solution under the present disclosure clearer, the accompanying drawings for illustrating the embodiments of the present disclosure are outlined below. Evidently, the accompanying drawings are for the exemplary purpose only, and those skilled in the art can derive other drawings from such accompanying drawings without making any creative effort.

DETAILED DESCRIPTION OF THE EMBODIMENTS

The technical solution under the present disclosure is expounded below with reference to accompanying drawings. Evidently, the embodiments given herein are for the exemplary purpose only, and are a part of rather than all of the embodiments of the present disclosure. Those skilled in the art can derive other embodiments from the embodiments given herein without making any creative effort, and all such embodiments are covered in the protection scope of the present disclosure.

Figure 1:
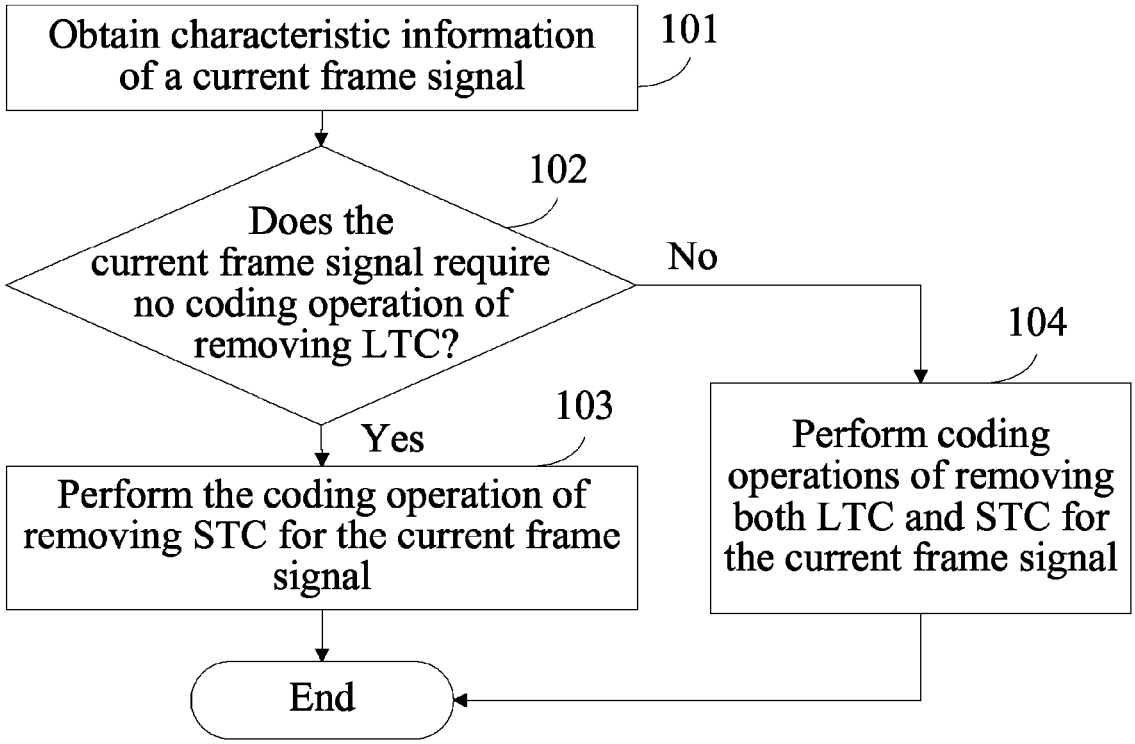
FIG. 1 is a flowchart of a first preprocessing method embodiment of the present disclosure.

The preprocessing method is introduced first below. FIG. 1 shows a process of a first preprocessing method embodiment of the present disclosure. The preprocessing method includes:

101: Obtain characteristic information of a current frame signal.

After the current frame signal is received, the characteristic information of the current frame signal may be obtained in the preset mode. The characteristic information may be an energy value and/or a periodicity factor parameter.

102: Identify whether the current frame signal requires no coding operation of removing Long Term Correlation (LTC) according to the characteristic information of the current frame signal and preset information; if the current frame signal requires no coding operation of removing LTC, the process proceeds to step 103; otherwise, the process proceeds to step 104.

The coding operation of removing LTC may be an LTP operation.

The preset information varies with the characteristic information. For example, if the characteristic information is an energy value, the preset information may be an absolute energy threshold, and/or an average energy value of background noise; if the characteristic information is a periodicity factor parameter, the preset information may be a periodicity factor threshold.

103: Perform the coding operation of removing Short Term Correlation (STC) for the current frame signal.

The coding operation of removing STC may be an LP operation.

For example, if coding operation is performed for the frame signal through LP operation and LTP operation, only the LP operation is performed for the current frame signal; if the coding operation is performed for the frame signal through other coding modes and the LTP operation, the coding operation is performed for the current frame signal only through other coding modes.

It is assumed that the coding operation of removing STC is LP operation. After the LP operation is performed for the current frame signal, LP residual signal and LP parameters are obtained. The LP parameters and the LP residual signal are coded and output as the bit stream of the current frame signal.

104: Perform coding operations of removing both LTC and STC for the current frame signal.

For example, if coding operation is performed for the frame signal through LP operation and LTP operation, both the LPC operation and the LTP operation are performed for the current frame; if the coding operation is performed for the frame signal through other coding modes and the LTP operation, the coding operation is performed for the current frame signal through other coding modes and the LTP operation.

It is assumed that the coding operation is performed for the frame signal through LP operation and LTP operation. After the LP operation is performed for the current frame signal, the LP residual signal and the LP parameters are obtained, the LTP operation is performed according to the current frame signal and the LP residual signal to obtain an LTP residual signal, and then the LTP decision is performed according to the LTP residual signal and the LP residual signal. Specifically, if the average amplitude of the LTP residual signal is less than the LP residual signal, it is deemed that the LTP operation is required, and the LTPFlag is set to 1; otherwise, it is deemed that no LTP operation is required, and the LTPFlag is set to 0. Afterward, the residual signal is selected according to the value of the LTPFlag to perform entropy coding, entropy coding is performed for the LTP residual when LTPFlag=1, and entropy coding is performed for the LP residual when LTPFlag=0.

It can be known from the above description that before performing the coding operation of removing LTC for the current frame signal, this embodiment identifies whether the current frame signal requires no coding operation of removing LTC, performs only the coding operation of removing STC for the current frame signal if identifying that the current frame signal requires no coding operation of removing LTC, and performs coding operations of removing both LTC and STC for the current frame signal as long as it is identified that the current frame signal requires the coding operation of removing LTC. Therefore, the coding operation of removing LTC is performed for only part of the input frame signals, the resource consumption caused by some coding operations for removing LTC is avoided, the coding complexity is reduced, and the coding efficiency is improved.

Figure 2:
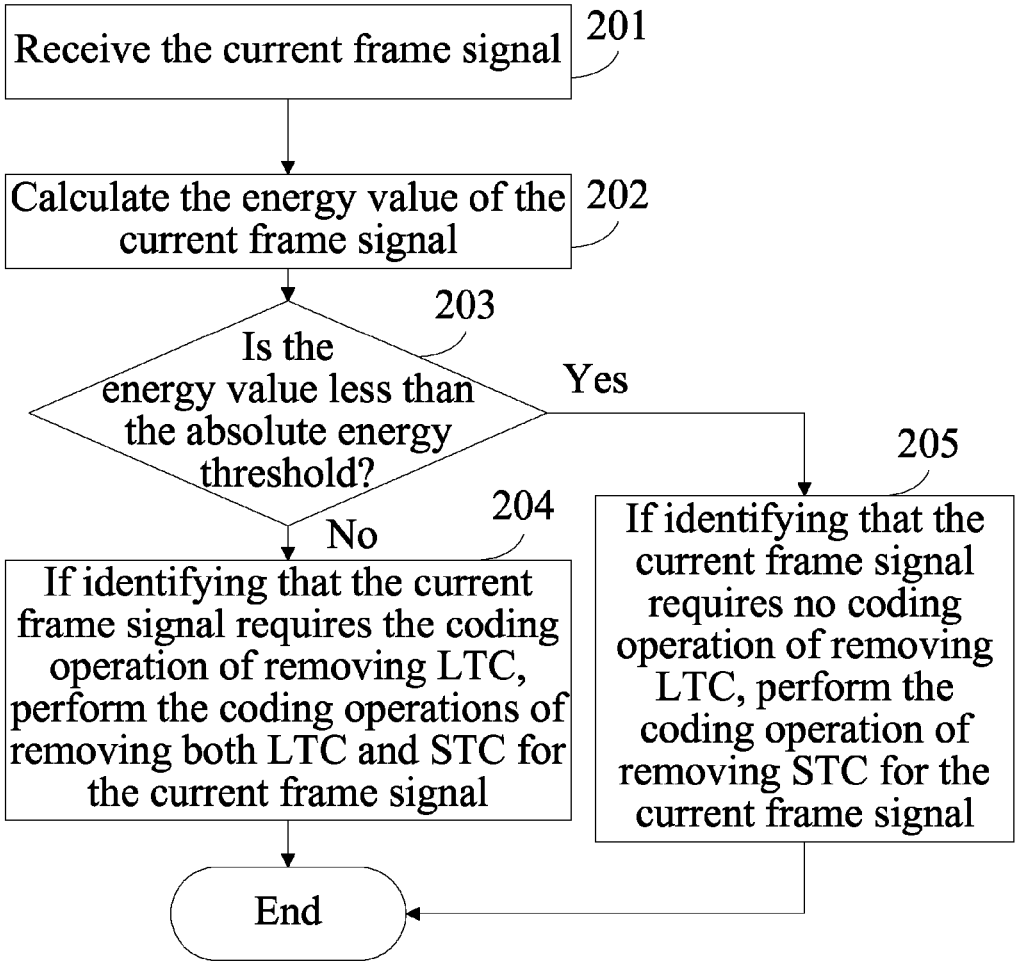
FIG. 2 is a flowchart of a second preprocessing method embodiment of the present disclosure.

FIG. 2 is a flowchart of a second preprocessing method embodiment of the present disclosure. The preprocessing method includes:

201: Receive the current frame signal.

202: Calculate the energy value of the current frame signal.

The energy value may be the direct energy value of the current frame signal, or a fixed-point normalized energy value. In this embodiment, it is assumed that the energy value is the direct energy value of the current frame signal.

The direct energy value of the current frame signal may be expressed by a logarithmic energy value, a square sum, or an absolute value. In this embodiment, the direct energy value is expressed by a square sum, and is calculated through the following formula:

$$E_1 = R(0) = \sum_{i=0}^{N-1} s^2(n) \text{ or } E_2 = \frac{1}{N} R(0)$$

where N is the frame length of the current frame signal, R(0) is the first autocorrelation coefficient, s(n) is the current frame signal, $E_1$ is a frame energy value, and $E_2$ is an average frame energy value.

If the direct energy value is expressed by a logarithmic energy value, and it is calculated through the following formula:

$$E_1' = \log_2[E_1] = \log_2[R(0)] \text{ or } E_2' = \log_2[E_2] = \log_2\left[\frac{1}{N}R(0)\right]$$

where $E_1'$ is the direct frame energy value and $E_2'$ is the average frame energy value.

If the energy value is a 32-bit fixed-point normalized energy value, after direct energy value of the current frame signal is calculated, the fixed-point normalized energy value of the current frame signal is calculated through norm=31−$E_1'$=31−$\log_2$ ($E_1$), where norm is a fixed-point normalized energy value. In some scenarios, the fixed-point normalized energy value may be a sum value (such as 30) of the direct frame energy value and other values which are empirically appropriate to those skilled in the art. In this case, the fixed-point normalized energy value may be calculated through norm=30−$\lfloor\log_2 [E_1]\rfloor$, where $\lfloor x\rfloor$ operator denotes a floor function, namely, $\lfloor x\rfloor=\max\{n\in\{\ldots,-2,-1,0,1,2,\ldots\}|x\geq n\}$.

203: Judge whether the energy value is less than the absolute energy threshold; if the energy value is less than the absolute energy threshold, the process proceeds to step 205; otherwise, the process proceeds to step 204.

The absolute energy threshold is a preset empiric value, and varies with the coding environment, the different audio and speech types. The absolute energy threshold may be obtained through training of a selected typical silence segment, or the absolute hearing threshold of human ears is set as the absolute energy threshold. The absolute energy threshold may be set according to the frame length of the received frame signal, namely, the absolute energy threshold corresponds to the frame length N of the received frame signal. The setting of the absolute energy threshold varies with the energy value of the current frame signal.

For example, when the energy value of the current frame is a direct energy value, the absolute energy threshold is represented by E_thr; when N is 160, E_thr may be set to 16; when N is 240, E_thr may be set to 17; when N is 320, E_thr may be set to 18. If the direct energy value is less than E_thr, the process proceeds to step 205; otherwise, the process proceeds to step 204.

In other scenarios, when the energy value of the current frame is the direct energy thr; value, the absolute energy threshold is represented by E_thr; when N is 160, E_thr may be set to 15; when N is 240, E_thr may be set to 16; when N is 320, E_thr may be set to 17. If the direct energy value is less than E_thr, the process proceeds to step 205; otherwise, the process proceeds to step 204.

When the energy value of the current frame is a fixed-point normalized energy value, the absolute energy threshold is represented by norm_thr; when N is 160, norm_thr may be set to 15; when N is 240, norm_thr may be set to 14; when N is 320, norm_thr may be set to 13. It should be noted that when the energy value of the current frame is a fixed-point normalized energy value norm, if norm is greater than norm_thr, the process proceeds to step 205; otherwise, the process proceeds to step 204.

204: If identifying that the current frame signal requires the coding operation of removing LTC, perform the coding operations of removing both LTC and STC for the current frame signal.

For details about the execution of step 204, reference may also be made to step 104.

205: If identifying that the current frame signal requires no coding operation of removing LTC, perform the coding operation of removing STC for the current frame signal.

For details about the execution of 205, reference may also be made to step 103.

It is understandable that in this embodiment, the energy value is compared with the absolute energy threshold to judge whether the current frame signal requires the coding operation of removing LTC. In practice, a further comparison may be performed between a difference and a difference threshold on the basis of this embodiment, where the difference refers to the difference between the energy value and the average energy value of the background noise. Therefore, it is identified that the current frame signal requires no coding operation of removing LTC if the difference is less than the difference threshold, and the energy value is less than the absolute energy threshold. Moreover, after it is identified that the current frame signal requires no the coding operation of removing LTC in this embodiment, a further comparison may be performed between the periodicity factor parameter of the current frame signal and the absolute periodicity factor threshold on the basis of this embodiment. Therefore, among the current frame signals identified as requiring no coding operation of removing LTC in this embodiment, the frame signals that require the coding operation of removing LTC may be selected according to the periodicity factor parameter, and the judgment is more accurate.

The judgment about the periodicity factor parameter may be replaced with the judgment about whether several frame signals prior to the current frame signal include an LTP frame. The number of the frame signals prior to the current frame signal may be set according to the frame length of the received current frame signal, namely, the number of the frame signals prior to the current frame signal corresponds to the frame length of the current frame signal. It is assumed that the number of the frame signals prior to the current frame signal is L. If the frame length is small, the L may be set to a greater value in order to ensure enough prior frame information for judging the characteristics of the current frame. Further, the setting of the L may allow for the decision performance and the algorithm complexity. For example, in an embodiment of the present disclosure, when N is 160, L may be set to 511; when N is 240, L may be set to 31; when N is 320, L may be set to 15.

It can be known from the above description that before performing the coding operation of removing LTC for the current frame signal, this embodiment identifies whether the current frame signal requires no coding operation of removing LTC according to the energy value of the current frame signal, performs only the coding operation of removing STC for the current frame signal if identifying that the current frame signal requires no coding operation of removing LTC, and performs coding operations of removing both LTC and STC for the current frame signal as long as it is identified that the current frame signal requires the coding operation of removing LTC. Therefore, the coding operation of removing LTC is performed for only part of the input frame signals, the resource consumption caused by some coding operations for removing LTC is avoided, the coding complexity is reduced, and the coding efficiency is improved.

Figure 3:
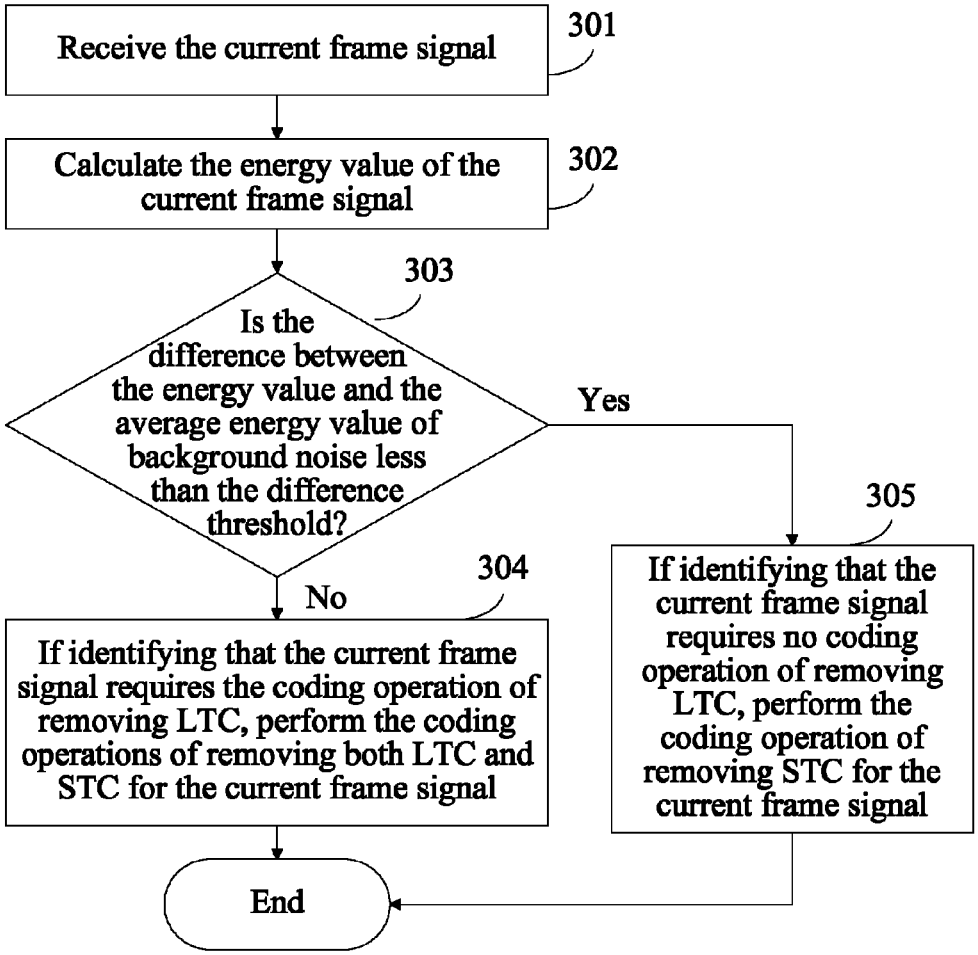
FIG. 3 is a flowchart of a third preprocessing method embodiment of the present disclosure.

FIG. 3 is a flowchart of a third preprocessing method embodiment of the present disclosure. The preprocessing method includes:

301: Receive the current frame signal.

302: Calculate the energy value of the current frame signal.

For details about the execution of step 302, reference may also be made to step 202.

303: Judge whether the difference between the energy value of the current frame signal and the average energy value of the background noise is less than the difference threshold;

if the difference is less than the difference threshold, the process proceeds to step 305; otherwise, the process proceeds to step 304.

If the current frame signal is designed to initialize the average energy value of the background noise, it is deemed by default that the coding operation of removing LTC is required; and the technical solution provided in this embodiment is applied to preprocessing as long as the current frame signal is not designed to initialize the average energy value of the background noise. The number of the frame signals for initialization may be set according to the frame length of the received frame signal, namely, the number of the frame signals for initializing the average energy value of the background noise corresponds to the frame length of the current frame signal. Because the initialization of the average energy value of the background noise requires a silence segment of certain duration, the number of the frame signals for initializing the average energy value of the background noise may be set to a great value. Specifically, the setting of the number of the frame signals for initializing the average energy value of the background noise may allow for the decision performance and the algorithm complexity. It is assumed that the number of the frame signals for initializing the average energy value of the background noise is P. In an embodiment of the present disclosure, when N is 160, P may be set to 8; when N is 240, P may be set to 4; when N is 320, P may be set to 4.

The average energy value of the background noise depends on the energy values of the frames prior to the current frame signal. The average energy value of the background noise varies with the current frame signal. Specifically, the initial value of the average energy value of the background noise is the average value of the energy of the first P frame signals. In this case, the initial average energy value of the background noise may be calculated through the following formula:

$$\overline{E} = \frac{1}{P}\sum_{i=0}^{P-1} E_i$$

where $E_i$ is the energy value of the first P frame signals, and $\overline{E}$ is the average energy value of the background noise.

In this embodiment, a buffer is set for the background noise. If the difference between the energy value and the average energy value of the background noise is less than the difference threshold, the energy value of the current frame signal is buffered into the buffer. After the energy values of a certain number of frame signals are stored in the buffer, the average energy value of the background noise is updated with the average value of the energy value of the frame signals in the buffer. Because the buffering of the energy values of the frame signals begins after completion of initializing the average energy value of the background noise (after the first P frame signals are received), the buffer has not buffered energy values of the frame signals before the initialization, and it is necessary to initialize the energy values of the frame signals in the buffer.

If a frame signal energy value is buffered into the buffer, the counter value of the buffer increases by 1. When the counter value reaches the maximum value, the average energy value of the background noise is updated with the average value of the energy values of the frame signals buffered in the buffer, and then the buffer is emptied, and the counter value is set to 0 and ready for buffering again. The maximum value of the counter value may be set according to the frame length of the received frame signal, namely, the maximum value of the counter value corresponds to the frame length of the current frame signal. Nevertheless, if the decision performance and the algorithm complexity are taken into account, the maximum value of the counter value may be set to a fixed value. Specifically, the setting of the maximum value of the counter value may allow for the decision performance and the algorithm complexity. It is assumed that the maximum value of the counter value is k. In an embodiment of the present disclosure, when N is 160, k may be set to 4; when N is 240, k may be set to 4; when N is 320, k may be set to 4.

304: If identifying that the current frame signal requires the coding operation of removing LTC, perform the coding operations of removing both LTC and STC for the current frame signal, and the process ends.

305: If identifying that the current frame signal requires no coding operation of removing LTC, perform the coding operation of removing STC for the current frame signal, and the process ends.

It is understandable that in this embodiment, the difference (namely, the difference between the energy value of the current frame signal and the average energy value of the background noise) is compared with the difference threshold to judge whether the current frame signal requires the coding operation of removing LTC. In practice, a further comparison may be performed between the energy value and the absolute energy threshold on the basis of this embodiment. Therefore, it is identified that the current frame signal requires no the coding operation of removing LTC as long as the difference is less than the difference threshold, and the energy value is less than the absolute energy threshold. Moreover, after it is identified that the current frame signal requires no the coding operation of removing LTC in this embodiment, a further comparison may be performed between the periodicity factor parameter of the current frame signal and the absolute periodicity factor threshold on the basis of this embodiment. Therefore, among the current frame signals identified as requiring no coding operation of removing LTC in this embodiment, the frame signals that require the coding operation of removing LTC may be selected according to the periodicity factor parameter, and the judgment is more accurate. The judgment about the periodicity factor parameter may be replaced with the judgment about whether several frame signals prior to the current frame signal include an LTP frame.

It can be known from the above description that before performing the coding operation of removing LTC for the current frame signal, this embodiment identifies whether the current frame signal requires no coding operation of removing LTC according to the energy value of the current frame signal, performs only the coding operation of removing STC for the current frame signal if identifying that the current frame signal requires no coding operation of removing LTC, and performs coding operations of removing both LTC and STC for the current frame signal as long as it is identified that the current frame signal requires the coding operation of removing LTC. Therefore, the coding operation of removing LTC is performed for only part of the input frame signals, the resource consumption caused by some coding operations for removing LTC is avoided, the coding complexity is reduced, and the coding efficiency is improved.

Figure 4:
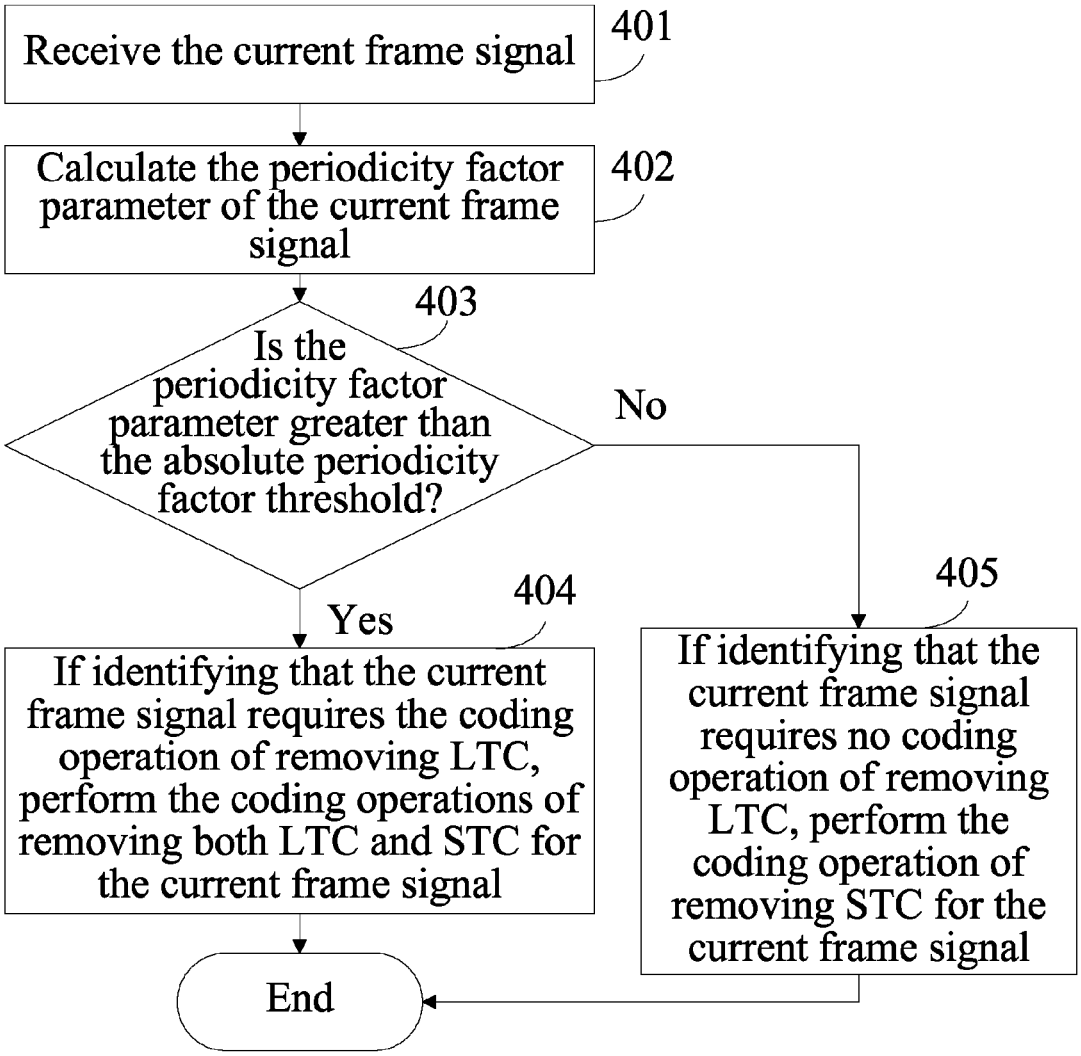
FIG. 4 is a flowchart of a fourth preprocessing method embodiment of the present disclosure.

FIG. 4 is a flowchart of a fourth preprocessing method embodiment of the present disclosure. The preprocessing method includes:

401: Receive the current frame signal.

402: Calculate the periodicity factor parameter of the current frame signal.

The periodicity factor parameter may be a parameter indicative of periodicity, for example, a pitch gain factor. The pitch gain factor may be obtained through the following formula:

$$\beta = \frac{\sum_{n=0}^{N-1} s(n)s^2(n-T)}{\sum_{n=0}^{N-1} s^2(n-T)}$$

where T is a pitch period, N is a frame length, and s(n) is a frame signal.

403: Judge whether the periodicity factor parameter is greater than the absolute periodicity factor threshold; if the periodicity factor parameter is greater than the absolute periodicity factor threshold, the process proceeds to step 404; otherwise, the process proceeds to step 405.

The absolute periodicity factor is preset empirically. If the periodicity factor parameter is greater than the absolute periodicity factor, it indicates that the current frame signal is periodical, and the current frame signal requires the coding operation of removing LTC.

404: If identifying that the current frame signal requires the coding operation of removing LTC, perform the coding operations of removing both LTC and STC for the current frame signal, and the process ends.

405: If identifying that the current frame signal requires no coding operation of removing LTC, perform the coding operation of removing STC for the current frame signal, and the process ends.

It is understandable that on the basis of this embodiment, a further comparison may be made between a difference and the difference threshold, where the difference refers to the difference between the energy value of the current frame signal and the average energy value of the background noise, and/or a further comparison may be made between the energy value and the absolute energy threshold to make the judgment more accurate.

It can be known from the above description that before performing the coding operation of removing LTC for the current frame signal, this embodiment identifies whether the current frame signal requires no coding operation of removing LTC according to the periodicity factor parameter of the current frame signal, performs only the coding operation of removing STC for the current frame signal if identifying that the current frame signal requires no coding operation of removing LTC, and performs coding operations of removing both LTC and STC for the current frame signal as long as it is identified that the current frame signal requires the coding operation of removing LTC. Therefore, the coding operation of removing LTC is performed for only part of the input frame signals, the resource consumption caused by some coding operations for removing LTC is avoided, the coding complexity is reduced, and the coding efficiency is improved.

Further, after the preprocessing method in the second to fourth embodiments of the present disclosure identifies that the current frame signal requires no coding operation of removing LTC, in order to make the judgment more accurate, the preprocessing method in the second to fourth embodiments of the present disclosure may further include the following steps: judge whether several frame signals prior to the current frame signal include an LTP frame; if several frame signals prior to the current frame signal include an LTP frame, re-identify that the current frame signal requires the coding operation of removing LTC; otherwise, identify that the current frame signal requires no coding operation of removing LTC. The LTP frame refers to the frame signal that requires the coding operation of removing LTC after the decision. Because adjacent frame signals generally take on similar characteristics, if the adjacent prior frame signals include an LTP frame, the current frame signal is probably an LTP frame too. Therefore, the judgment is more accurate if the judgment about whether the current frame signal requires the coding operation of removing LTC is made on the basis of judging whether the frame signals prior to the current frame signal include an LTP frame.

Figure 5:
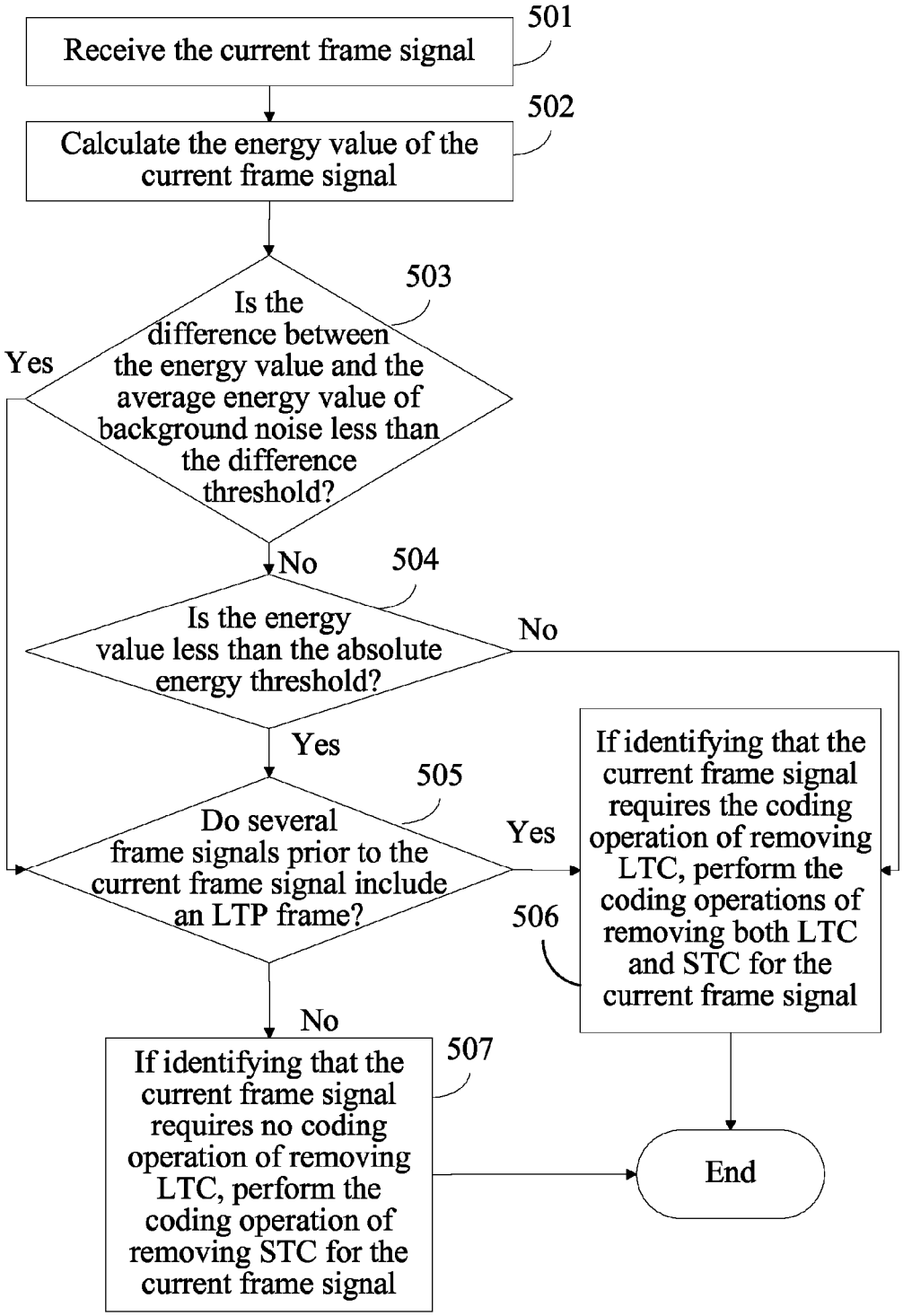
FIG. 5 is a flowchart of a fifth preprocessing method embodiment of the present disclosure.

FIG. 5 is a flowchart of a fifth preprocessing method embodiment of the present disclosure. The preprocessing method includes:

501: Receive the current frame signal.

502: Calculate the energy value of the current frame signal.

For details about the execution of step 502, reference may also be made to step 202.

503: Judge whether the difference between the energy value of the current frame signal and the average energy value of the background noise is less than the difference threshold; if the difference is less than the difference threshold, the process proceeds to step 505; otherwise, the process proceeds to step 504.

For details about the execution of step 503, reference may also be made to step 303.

504: Judge whether the energy value is less than the absolute energy threshold; if the energy value is less than the absolute energy threshold, the process proceeds to step 505; otherwise, the process proceeds to step 506.

For details about the execution of step 504, reference may also be made to step 203.

505: Judge whether several frame signals prior to the current frame signal include an LTP frame; if several frame signals prior to the current frame signal include an LTP frame, the process proceeds to step 506; otherwise, the process proceeds to step 507.

The judgment in step 505 may be replaced with the judgment about whether the periodicity factor parameter is greater than the absolute periodicity factor threshold.

506: If identifying that the current frame signal requires the coding operation of removing LTC, perform the coding operations of removing both LTC and STC for the current frame signal, and the process ends.

507: If identifying that the current frame signal requires no coding operation of removing LTC, perform the coding operation of removing STC for the current frame signal, and the process ends.

It can be known from the above description that before performing the coding operation of removing LTC for the current frame signal, this embodiment identifies whether the current frame signal requires no coding operation of removing LTC according to the periodicity factor parameter and the energy value of the current frame signal and according to whether several frame signals prior to the current frame signal include an LTP frame, performs only the coding operation of removing STC for the current frame signal if identifying that the current frame signal requires no coding operation of removing LTC, and performs coding operations of removing both LTC and STC for the current frame signal as long as it is identified that the current frame signal requires the coding operation of removing LTC. Therefore, the coding operation of removing LTC is performed for only part of the input frame signals, the resource consumption caused by some coding operations for removing LTC is avoided, the coding complexity is reduced, and the coding efficiency is improved.

Figure 6:
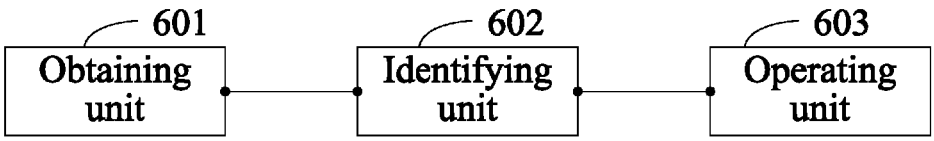
FIG. 6 is a structure diagram of a first preprocessing apparatus embodiment of the present disclosure.

The preprocessing apparatus under the present disclosure is introduced below. FIG. 6 is a structure diagram of a first preprocessing apparatus embodiment of the present disclosure. The preprocessing apparatus includes: (1) an obtaining unit 601, configured to receive the current frame signal; (2) an identifying unit 602, configured to identify whether the current frame signal received by the obtaining unit 601 requires no coding operation of removing LTC; and (3) an operating unit 603, configured to perform the coding operation of removing STC for the current frame signal if the identifying unit 602 identifies that the current frame signal requires no coding operation of removing LTC; or perform coding operations of removing both LTC and STC for the current frame signal if the identifying unit 602 identifies that the current frame signal requires the coding operation of removing LTC.

It can be known from the above description that before performing the coding operation of removing LTC for the current frame signal, the preprocessing apparatus in this embodiment identifies whether the current frame signal requires no coding operation of removing LTC, performs only the coding operation of removing STC for the current frame signal if identifying that the current frame signal requires no coding operation of removing LTCD, and performs coding operations of removing both LTC and STC for the current frame signal as long as it is identified that the current frame signal requires the coding operation of removing LTC. Therefore, the coding operation of removing LTC is performed for only part of the input frame signals, the resource consumption caused by some coding operations for removing LTC is avoided, the coding complexity is reduced, and the coding efficiency is improved.

Figure 7:
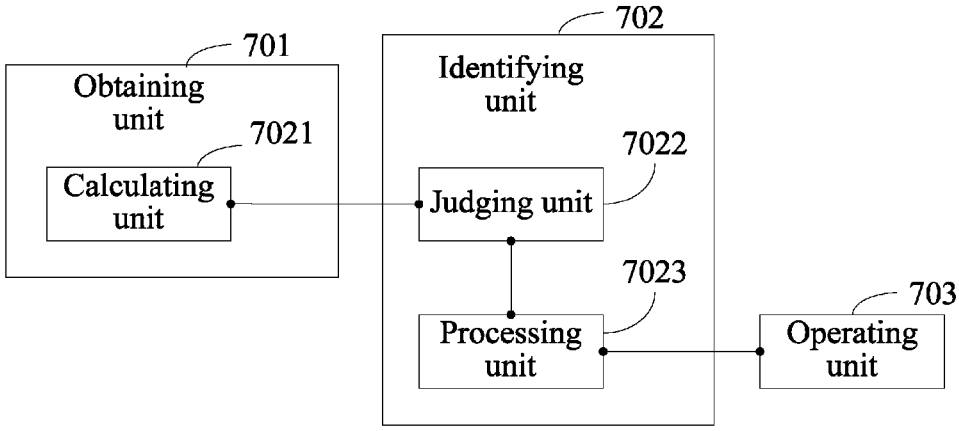
FIG. 7 is a structure diagram of a second preprocessing apparatus embodiment of the present disclosure.

FIG. 7 is a structure diagram of a second preprocessing apparatus embodiment of the present disclosure. The preprocessing apparatus includes: (1) an obtaining unit 701, configured to receive the current frame signal, where the obtaining unit 701 may further include: a calculating unit 7021, configured to calculate the energy value of the current frame signal received by the obtaining unit 701; (2) an identifying unit 702, configured to identify whether the current frame signal received by the obtaining unit 701 requires no coding operation of removing LTC, where the identifying unit 702 may further include: (a) a judging unit 7022, configured to judge whether the energy value calculated out by the calculating unit 7021 is less than the absolute energy threshold; and (b) a processing unit 7023, configured to identify that the current frame signal requires no coding operation of removing LTC if the judging unit 7022 identifies that the energy value is less than the absolute energy threshold, and identify that the current frame signal requires the coding operation of removing LTC if the judging unit 7022 identifies that the energy value is greater than or equal to the absolute energy threshold; and (3) an operating unit 703, configured to perform the coding operation of removing STC for the current frame signal if the identifying unit 702 (more specifically, processing unit 7023) identifies that the current frame signal requires no coding operation of removing LTC; or perform coding operations of removing both LTC and STC for the current frame signal if the identifying unit 702 (more specifically, processing unit 7023) identifies that the current frame signal requires the coding operation of removing LTC.

It can be known from the above description that before performing the coding operation of removing LTC for the current frame signal, the preprocessing apparatus in this embodiment identifies whether the current frame signal requires no coding operation of removing LTC according to the energy value of the current frame signal, performs only the coding operation of removing STC for the current frame signal if identifying that the current frame signal requires no coding operation of removing LTC, and performs coding operations of removing both LTC and STC for the current frame signal as long as it is identified that the current frame signal requires the coding operation of removing LTC. Therefore, the coding operation of removing LTC is performed for only part of the input frame signals, the resource consumption caused by some coding operations for removing LTC is avoided, the coding complexity is reduced, and the coding efficiency is improved.

Further, the judging unit 7022 included in the second preprocessing apparatus embodiment may be further configured to judge whether several frame signals prior to the current frame signal include an LTP frame if the processing unit 7023 identifies that the current frame signal requires no coding operation of removing LTC. In this case, the processing unit 7023 is further configured to identify that the current frame signal requires the coding operation of removing LTC if the judging unit 7022 identifies that several frame signals prior to the current frame signal include an LTP frame, and re-identify that the current frame signal requires no coding operation of removing LTC if the judging unit 7022 identifies that none of the several frame signals prior to the current frame signal includes an LTP frame. In this way, the judgment is more accurate.

The third preprocessing apparatus embodiment of the present disclosure includes: an obtaining unit, an identifying unit, and an operating unit.

The obtaining unit is configured to receive the current frame signal. The obtaining unit may include a calculating unit, configured to calculate the energy value of the current frame signal received by the obtaining unit.

The identifying unit is configured to identify whether the current frame signal received by the obtaining unit requires no coding operation of removing LTC.

The identifying unit may further include: (1) a judging unit, configured to judge whether a difference between the energy value calculated out by the calculating unit and the average energy value of the background noise is less than the difference threshold; and (2) a processing unit, configured to identify that the current frame signal requires no coding operation of removing LTC if the judging unit identifies that the difference between the energy value and the average energy value of the background noise is less than the difference threshold, and identify that the current frame signal requires the coding operation of removing LTC if the judging unit identifies that the difference between the energy value and the average energy value of the background noise is greater than or equal to the difference threshold.

The operating unit is configured to perform the coding operation of removing STC for the current frame signal if the identifying unit (more specifically, processing unit) identifies that the current frame signal requires no coding operation of removing LTC; or perform coding operations of removing both LTC and STC for the current frame signal if the identifying unit (more specifically, processing unit) identifies that the current frame signal requires the coding operation of removing LTC.

It can be known from the above description that before performing the coding operation of removing LTC for the current frame signal, the preprocessing apparatus in this embodiment identifies whether the current frame signal requires no coding operation of removing LTC according to the energy value of the current frame signal, performs only the coding operation of removing STC for the current frame signal if identifying that the current frame signal requires no coding operation of removing LTC, and performs coding operations of removing both LTC and STC for the current frame signal as long as it is identified that the current frame signal requires the coding operation of removing LTC. Therefore, the coding operation of removing LTC is performed for only part of the input frame signals, the resource consumption caused by some coding operations for removing LTC is avoided, the coding complexity is reduced, and the coding efficiency is improved.

Further, the judging unit included in the third preprocessing apparatus embodiment may be further configured to judge whether several frame signals prior to the current frame signal include an LTP frame if the processing unit identifies that the current frame signal requires no coding operation of removing LTC. In this case, the processing unit is further configured to identify that the current frame signal requires the coding operation of removing LTC if the judging unit identifies that several frame signals prior to the current frame signal include an LTP frame, and re-identify that the current frame signal requires no coding operation of removing LTC if the judging unit identifies that none of the several frame signals prior to the current frame signal includes an LTP frame. In this way, the judgment is more accurate.

The fourth preprocessing apparatus embodiment of the present disclosure includes: an obtaining unit, an identifying unit, and an operating unit.

The obtaining unit is configured to receive the current frame signal. The obtaining unit may include a calculating unit, configured to calculate the periodicity factor parameter of the current frame signal received by the obtaining unit.

The identifying unit is configured to identify whether the current frame signal received by the obtaining unit requires a coding operation of removing LTC, where the identifying unit may include: (1) a judging unit, configured to judge whether the periodicity factor parameter calculated out by the calculating unit is greater than the periodicity factor threshold; and (2) a processing unit, configured to identify that the current frame signal requires no coding operation of removing LTC if the judging unit identifies that the periodicity factor parameter is less than or equal to the periodicity factor threshold, and identify that the current frame signal requires the coding operation of removing LTC if the judging unit identifies that the periodicity factor parameter is greater than the periodicity factor threshold.

The operating unit is configured to perform the coding operation of removing STC for the current frame signal if the identifying unit (more specifically, processing unit) identifies that the current frame signal requires no coding operation of removing LTC; or perform coding operations of removing both LTC and STC for the current frame signal if the identifying unit (more specifically, processing unit) identifies that the current frame signal requires the coding operation of removing LTC.

It can be known from the above description that before performing the coding operation of removing LTC for the current frame signal, the preprocessing apparatus in this embodiment identifies whether the current frame signal requires no coding operation of removing LTC according to the periodicity factor parameter of the current frame signal, performs only the coding operation of removing STC for the current frame signal if identifying that the current frame signal requires no coding operation of removing LTC, and performs coding operations of removing both LTC and STC for the current frame signal as long as it is identified that the current frame signal requires the coding operation of removing LTC. Therefore, the coding operation of removing LTC is performed for only part of the input frame signals, the resource consumption caused by some coding operations for removing LTC is avoided, the coding complexity is reduced, and the coding efficiency is improved.

Further, the judging unit included in the fourth preprocessing apparatus embodiment may be further configured to judge whether several frame signals prior to the current frame signal include an LTP frame if the processing unit identifies that the current frame signal requires no coding operation of removing LTC. In this case, the processing unit is further configured to identify that the current frame signal requires the coding operation of removing LTC if the judging unit identifies that several frame signals prior to the current frame signal include an LTP frame, and re-identify that the current frame signal requires no coding operation of removing LTC if the judging unit identifies that none of the several frame signals prior to the current frame signal includes an LTP frame. In this way, the judgment is more accurate.

Figure 8:
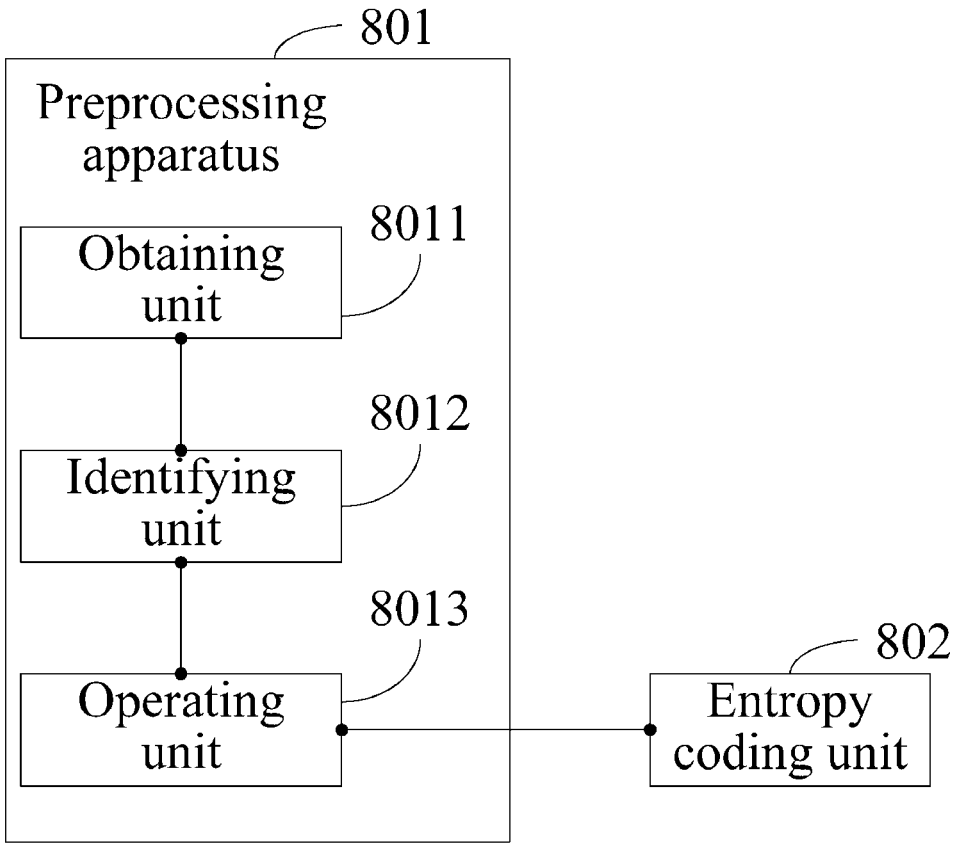
FIG. 8 is a structure diagram of a coding device in an embodiment of the present disclosure.

A coding device is provided in an embodiment of the present disclosure. FIG. 8 is a structure diagram of the coding device. The coding device includes a preprocessing apparatus 801 and an entropy coding apparatus 802.

The preprocessing apparatus 801 is configured to (1) obtain characteristic information of a current frame signal; (2) identify whether the current frame signal requires no coding operation of removing LTC according to the characteristic information of the current frame signal and preset information; and (3) perform a coding operation of removing STC for the current frame signal if the current frame signal requires no coding operation of removing LTC, or perform coding operations of removing both LTC and STC for the current frame signal if the current frame signal requires the coding operation of removing LTC.

More specifically, the preprocessing apparatus 801 in the coding device in this embodiment may include an obtaining unit 8011, an identifying unit 8012, and an operating unit 8013.

The obtaining unit 8011 is configured to calculate the energy value of the current frame signal. The identifying unit 8012 is configured to judge whether the energy value calculated out by the obtaining unit 8011 is less than the absolute energy threshold. The operating unit 8013 is configured to perform coding operations of removing both LTC and STC for the current frame signal if the identifying unit 8012 identifies that the energy value is greater than or equal to the absolute energy threshold, and perform the coding operation of removing STC for the current frame signal if the identifying unit identifies that the energy value is less than the absolute energy threshold.

Alternatively, the obtaining unit 8011 is configured to calculate the energy value of the current frame signal. The identifying unit 8012 is configured to judge whether a difference between the energy value calculated out by the obtaining unit 8011 and the average energy value of the background noise is less than the difference threshold. The operating unit 8013 is configured to perform coding operations of removing both LTC and STC for the current frame signal if the identifying unit 8012 identifies that the difference between the energy value and the average energy value of the background noise is greater than or equal to the difference threshold, and perform the coding operation of removing STC for the current frame signal if the identifying unit 8012 identifies that the difference between the energy value and the average energy value of the background noise is less than the difference threshold.

Alternatively, the obtaining unit 8011 is configured to calculate the periodicity factor parameter of the current frame signal. The identifying unit 8012 is configured to judge whether the periodicity factor parameter calculated out by the obtaining unit 8011 is greater than the periodicity factor threshold. The operating unit 8013 is configured to perform coding operations of removing both LTC and STC for the current frame signal if the identifying unit 8012 identifies that the periodicity factor parameter is greater than the periodicity factor threshold, and perform the coding operation of removing STC for the current frame signal if the identifying unit 8012 identifies that the periodicity factor parameter is less than or equal to the periodicity factor threshold;

The entropy coding apparatus 802 is configured to perform entropy coding for the current frame signal by using a result of the coding operation performed by the preprocessing apparatus 801.

It can be known from the above description that before performing the coding operation of removing LTC for the current frame signal, the coding device in this embodiment identifies whether the current frame signal requires no coding operation of removing LTC, performs only the coding operation of removing STC for the current frame signal if identifying that the current frame signal requires no coding operation of removing LTC, and performs coding operations of removing both LTC and STC for the current frame signal as long as it is identified that the current frame signal requires the coding operation of removing LTC. Therefore, the coding operation of removing LTC is performed for only part of the input frame signals, the resource consumption caused by some coding operations for removing LTC is avoided, the coding complexity is reduced, and the coding efficiency is improved.

Further, the identifying unit 8012 included in the preprocessing apparatus 801 in the coding device in this embodiment may be further configured to judge whether several frame signals prior to the current frame signal include an LTP frame before the operating unit 8013 performs the coding operation of removing STC for the current frame signal. In this case, the operating unit 8013 is configured to perform the coding operation of removing STC for the current frame signal if the identifying unit 8012 identifies that none of the several frame signals prior to the current frame signal includes the LTP frame, and perform coding operations of removing both LTC and STC for the current frame signal if the identifying unit 8012 identifies that several frame signals prior to the current frame signal include the LTP frame. The judgment about whether several frame signals prior to the current frame signal include the LTP frame makes the judgment more accurate.

It is understandable to those skilled in the art that all or part of the steps of the foregoing embodiments may be implemented by hardware instructed by a computer program. The program may be stored in a computer-readable storage medium. When being executed, the program performs the processes covered in the foregoing embodiments. The storage medium may be a magnetic disk, Compact Disk (CD), Read-Only Memory (ROM), or Random Access Memory (RAM).

Elaborated above are a preprocessing method, a preprocessing apparatus, and a coding device under the present disclosure. Although the disclosure is described through some exemplary embodiments, the disclosure is not limited to such embodiments. It is apparent that those skilled in the art can make modifications and variations to the disclosure without departing from the spirit and scope of the disclosure. The disclosure is intended to cover the modifications and variations provided that they fall in the scope of protection defined by the following claims or their equivalents.

What is claimed is:

1. A preprocessing method, comprising:

obtaining characteristic information of a current frame signal;

identifying whether the current frame signal requires no coding operation of removing Long Term Correlation (LTC) according to the characteristic information of the current frame signal and preset information; and if the current frame signal requires no coding operation of removing LTC, performing a coding operation of removing Short Term Correlation (STC) for the current frame signal; if the current frame signal requires the coding operation of removing LTC, performing coding operations of removing both LTC and STC for the current frame signal;

wherein the characteristic information of the current frame signal is an energy value of the current frame signal;

the identifying of whether the current frame signal requires no coding operation of removing LTC according to the characteristic information of the current frame signal and the preset information comprises:

judging whether the energy value of the current frame signal is less than an absolute energy threshold, wherein the absolute energy threshold corresponds to a frame length of the current frame signal; and identifying that the current frame signal requires no coding operation of removing LTC if the energy value is less than the absolute energy threshold.

2. The preprocessing method according to claim 1, wherein before identifying that the current frame signal requires no coding operation of removing LTC, the method further comprises:

judging whether several frame signals prior to the current frame signal comprise any Long Term Prediction (LTP) frame, wherein the number of the frame signals prior to the current frame signal corresponds to the frame length of the current frame signal; and identifying that the current frame signal requires no coding operation of removing LTC if none of the several frame signals prior to the current frame signal comprises the LTP frame.

3. The preprocessing method of claim 1, wherein:

the characteristic information of the current frame signal is an energy value of the current frame signal;

if the current frame signal is not designed to initialize an average energy value of background noise, the identifying of whether the current frame signal requires no coding operation of removing LTC according to the characteristic information of the current frame signal and the preset information comprises:

judging whether a difference between the energy value of the current frame signal and the average energy value of the background noise is less than a difference threshold, wherein: an initial value of the average energy value of the background noise is an average energy value of frame signals for initializing the average energy value of the background noise; and the number of the frame signals for initializing the average energy value of the background noise corresponds to a frame length of the current frame signal; and identifying that the current frame signal requires no coding operation of removing LTC if the difference is less than the difference threshold.

4. The preprocessing method according to claim 3, wherein before identifying that the current frame signal requires no coding operation of removing LTC, the method further comprises:

judging whether several frame signals prior to the current frame signal comprise any Long Term Prediction (LTP) frame, wherein the number of the frame signals prior to the current frame signal corresponds to the frame length of the current frame signal; and identifying that the current frame signal requires no coding operation of removing LTC if none of the several frame signals prior to the current frame signal comprises the LTP frame.

5. The preprocessing method of claim 3, wherein if the difference is less than the difference threshold, the method further comprises:

buffering the energy value of the current frame signal into a buffer, and increasing a counter value of the buffer by 1.

6. The preprocessing method of claim 5, further comprising:

using an average value of energy values of the frame signals buffered in the buffer as the average energy value of the background noise if the counter value is a maximum value which corresponds to the frame length of the current frame signal; and setting the counter value to 0, and emptying the buffer.

7. The preprocessing method of claim 1, wherein:

the characteristic information of the current frame signal is a periodicity factor parameter of the current frame signal;

the identifying of whether the current frame signal requires no coding operation of removing LTC according to the characteristic information of the current frame signal and the preset information comprises:

judging whether the periodicity factor parameter is greater than a periodicity factor threshold; and identifying that the current frame signal requires no coding operation of removing LTC if the periodicity factor parameter is less than or equal to the periodicity factor threshold.

8. The preprocessing method according to claim 7, wherein before identifying that the current frame signal requires no coding operation of removing LTC, the method further comprises:

judging whether several frame signals prior to the current frame signal comprise any Long Term Prediction (LTP) frame, wherein the number of the frame signals prior to the current frame signal corresponds to the frame length of the current frame signal; and identifying that the current frame signal requires no coding operation of removing LTC if none of the several frame signals prior to the current frame signal comprises the LTP frame.

9. A preprocessing apparatus comprising:

an obtaining unit, of a device, configured to obtain characteristic information of a current frame signal;

an identifying unit, configured to identifying whether the current frame signal requires no coding operation of removing Long Term Correlation (LTC) according to the characteristic information of the current frame signal obtained by the obtaining unit and preset information; and an operating unit, configured to perform coding operations of removing both LTC and Short Term Correlation (STC) for the current frame signal if the identifying unit identifies that the current frame signal requires the coding operation of removing LTC; or perform the coding operation of removing STC for the current frame signal if the identifying unit identifies that the current frame signal requires no coding operation of removing LTC;

wherein the obtaining unit comprises a calculating unit which is configured to calculate an energy value or a periodicity factor parameter of the current frame signal;

wherein the identifying unit comprises: a judging unit, configured to judge whether the energy value calculated out by the calculating unit is less than an absolute energy threshold; and a processing unit, configured to identify that the current frame signal requires the coding operation of removing LTC if the judging unit identifies that the energy value is greater than or equal to the absolute energy threshold, and identify that the current frame signal requires no coding operation of removing LTC if the judging unit identifies that the energy value is less than the absolute energy threshold.

10. The preprocessing apparatus according to claim 9, wherein:

the judging unit is further configured to judge whether several frame signals prior to the current frame signal comprise any Long Term Prediction (LTP) frame if the processing unit identifies that the current frame signal requires no coding operation of removing LTC; and the processing unit is further configured to re-identify that the current frame signal requires the coding operation of removing LTC if the judging unit identifies that the several frame signals prior to the current frame signal comprise any LTP frame.

11. The preprocessing apparatus of claim 9, wherein the identifying unit comprises:

a judging unit, configured to judge whether a difference between the energy value calculated out by the calculating unit and an average energy value of background noise is less than a difference threshold; and a processing unit, configured to identify that the current frame signal requires the coding operation of removing LTC if the judging unit identifies that the difference between the energy value and the average energy value of the background noise is greater than or equal to the difference threshold, and identify that the current frame signal requires no coding operation of removing LTC if the judging unit identifies that the difference between the energy value and the average energy value of the background noise is less than the difference threshold.

12. The preprocessing apparatus of claim 9, wherein the identifying unit comprises:

a judging unit, configured to judge whether the periodicity factor parameter calculated out by the calculating unit is greater than a periodicity factor threshold; and a processing unit, configured to identify that the current frame signal requires no coding operation of removing LTC if the judging unit identifies that the periodicity factor parameter is less than or equal to the periodicity factor threshold, and identify that the current frame signal requires the coding operation of removing LTC if the judging unit identifies that the periodicity factor parameter is greater than the periodicity factor threshold.

13. A coding device, comprising:

preprocessing apparatus, configured to obtain characteristic information of a current frame signal; identify whether the current frame signal requires no coding operation of removing Long Term Correlation (LTC) according to the characteristic information of the current frame signal and preset information; perform a coding operation of removing Short Term Correlation (STC) for the current frame signal if the current frame signal requires no coding operation of removing LTC, or perform coding operations of removing both LTC and STC for the current frame signal if the current frame signal requires the coding operation of removing LTC; and an entropy coding apparatus, configured to perform entropy coding for the current frame signal by using a result of the coding operation;

wherein the preprocessing apparatus comprises:

an obtaining unit, configured to calculate an energy value of the current frame signal;

an identifying unit, configured to judge whether the energy value calculated out by the obtaining unit is less than an absolute energy threshold; and an operating unit, configured to perform coding operations of removing both the LTC and STC for the current frame signal if the identifying unit identifies that the energy value is greater than or equal to the absolute energy threshold, or perform the coding operation of removing STC for the current frame signal if the identifying unit identifies that the energy value is less than the absolute energy threshold.

14. The coding device according to claim 13, wherein:

the identifying unit is further configured to judge whether several frame signals prior to the current frame signal comprise any Long Term Prediction (LTP) frame before the operating unit performs the coding operation of removing STC for the current frame signal; and the operating unit is configured to perform the coding operation of removing STC for the current frame signal as long as the identifying unit identifies that none of the several frame signals prior to the current frame signal comprises the LTP frame, or perform coding operations of removing both the LTC and STC for the current frame signal if the identifying unit identifies that the several frame signals prior to the current frame signal comprise any LTP frame.

15. The coding device of claim 13, wherein the preprocessing apparatus comprises:

an obtaining unit, configured to calculate an energy value of the current frame signal;

an identifying unit, configured to judge whether a difference between the energy value calculated out by the obtaining unit and an average energy value of background noise is less than a difference threshold; and an operating unit, configured to perform coding operations of removing both the LTC and STC for the current frame signal if the identifying unit identifies that the difference between the energy value and the average energy value of the background noise is greater than or equal to the difference threshold, or perform the coding operation of removing STC for the current frame signal if the identifying unit identifies that the difference between the energy value and the average energy value of the background noise is less than the difference threshold.

16. The coding device of claim 13, wherein the preprocessing apparatus comprises:

an obtaining unit, configured to calculate a periodicity factor parameter of the current frame signal;

an identifying unit, configured to judge whether the periodicity factor parameter calculated out by the obtaining unit is greater than a periodicity factor threshold; and an operating unit, configured to perform coding operations of removing both the LTC and STC for the current frame signal if the identifying unit identifies that the periodicity factor parameter is greater than the periodicity factor threshold, or perform the coding operation of removing STC for the current frame signal if the identifying unit identifies that the periodicity factor parameter is less than or equal to the periodicity factor threshold.

* * * * *